US010801171B1

(12) United States Patent
McCormick

(10) Patent No.: US 10,801,171 B1
(45) Date of Patent: Oct. 13, 2020

(54) HYGIENIC PULLING WASTE COLLECTOR

(71) Applicant: Joseph McCormick, Homer Glen, IL (US)

(72) Inventor: Joseph McCormick, Homer Glen, IL (US)

( * ) Notice: Subject to any disclaimer, the term of this patent is extended or adjusted under 35 U.S.C. 154(b) by 0 days.

(21) Appl. No.: 16/441,224

(22) Filed: Jun. 14, 2019

(51) Int. Cl.
*E01H 1/12* (2006.01)

(52) U.S. Cl.
CPC ... *E01H 1/1206* (2013.01); *E01H 2001/1293* (2013.01)

(58) Field of Classification Search
CPC ..... E01H 1/1206; E01H 2001/122; E01H 2001/1226; E01H 2001/1293
USPC ..... 294/1.4
See application file for complete search history.

(56) References Cited

U.S. PATENT DOCUMENTS 5,503,442 A * 4/1996 Lee ..... E01H 1/1206 294/1.4
6,039,369 A * 3/2000 Stahovic ..... E01H 1/1206 15/257.2
7,178,843 B2 * 2/2007 Askinasi ..... E01H 1/1206 294/1.4
7,287,790 B1 * 10/2007 Kitiashvili ..... E01H 1/1206 294/1.4
8,011,705 B1 * 9/2011 Holbrook ..... E01H 1/1206 294/1.4
8,556,309 B1 * 10/2013 Charette ..... E01H 1/1206 294/1.4
8,714,604 B1 * 5/2014 Mihalic ..... E01H 1/1206 294/1.4
9,091,031 B2 * 7/2015 Naseem ..... E01H 1/1206
10,370,810 B1 * 8/2019 Times ..... E01H 1/1206
2009/0072559 A1 * 3/2009 Wilkerson ..... E01H 1/1206 294/1.4
2011/0193359 A1 * 8/2011 Howard ..... E01H 1/1206 294/1.3
2016/0153158 A1 * 6/2016 Karius ..... E01H 1/1206 294/1.4

OTHER PUBLICATIONS

Living Express 28" Large Pooper Scooper for Dog-Long Handle Dog Poop Scooper-Pet Waste Pick Up Jaw Scooper Without Smelling,Durable Spring Easy to Use,Perfect for Grass,Dirt,Gravel; https://www.amazon.com/Living-Express-Dog-Long-Scooper-Pet-Smelling/dp/B019IIMSOK/ref=zg_bs_3052415011_7?_encoding=UTF8&psc=1&refRID=S0PJAT8WK9X7STBBY1JM.

* cited by examiner

*Primary Examiner* — Dean J Kramer
(74) *Attorney, Agent, or Firm* — The Law Offices of Konrad Sherinian LLC

(57) ABSTRACT

A hygienic pulling waste collector includes a frame with a leg, two frame arms coupled to the leg, a frame handle coupled to the leg, a rod coupled to the two frame arms, and two claws rotatably coupled to the rod and also attached to the two frame arms. The collector also includes a puller assembly having a puller handle, a puller frame, two puller arms coupled to the puller frame and attached to the two claws, and a spring coupled to the puller frame and the rod. The collector further includes a first locking member mounted to the leg, and a second locking member unevenly mounted to the rod. The puller frame is adapted to move inside the cavity disposed the leg. The first and second locking members each include a cover made of flexible material and incorporate a through cut.

14 Claims, 4 Drawing Sheets

HYGIENIC PULLING WASTE COLLECTOR

CROSS REFERENCE TO RELATED APPLICATIONS

This application is related to U.S. patent application Ser. No. 16/034,247, entitled "IMPROVED WASTE COLLECTOR," filed Jul. 12, 2018.

FIELD OF THE DISCLOSURE

The present disclosure generally relates to object collecting devices. More particularly, the present disclosure relates to a hygienic waste collecting device having a waste container attachment mechanism to allow for convenient and clean removal of collected waste from the collecting device. More particularly still, the present disclosure relates to a hygienic pulling waste collecting device.

BACKGROUND

Waste collecting devices are oftentimes used as temporary receptacles for small amounts of waste, such as dust, candy wrappers, discarded food, etc., as well as refuse, such as vomit, animal feces, etc. Waste collectors take different forms. For example, some waste collectors allow user to scoop up an object. However, after the waste collected into the receptacle is emptied, the receptacle can still contain some amount of the waste that is stuck to the interior surface of the receptacle. For instance, when the waste is dog feces, the small amount of the waste attached to the inside surface of the receptacle would produce undesirable smell, sanitation hazard, and an unwanted scene. It is inconvenient to thoroughly clean the receptacle each time the waste collector is used. The sanitation issue prevents wider use of such devices. Accordingly, there is a need for a new type of waste collectors that are convenient to use and allows complete removal of collected waste therein. Furthermore, the new type of waste collectors is applicable for collecting both solid and soft objects.

A scooping device, also referred to herein as a pulling waste collector, usually incorporates two jaws operated by a puller. The two jaws open and close to collect an object, such as a piece of waste. However, the scooping devices for collecting waste present the same issues, such as undesirable smell, sanitation hazard, and an unwanted scene. Accordingly, there is a need for a new type of pulling waste collectors that provides a hygienic solution for waste collection, and convenient and complete removal of the collected waste from the collector.

OBJECTS OF THE DISCLOSED HYGIENIC WASTE COLLECTOR

Accordingly, it is an object of this disclosure to provide a waste collector that does not make direct contact with the collected waste.

Another object of the disclosure is to provide a waste collector that does not require cleaning after use.

Another object of the disclosure is to provide a waste collector that is odorless after use.

Another object of the disclosure is to provide a waste collector with a set of locking members for keeping a waste container open and in position.

Another object of the disclosure is to provide a waste collector with a set of locking members allowing convenient removal of a waste container disposed in the waste collector.

Another object of the disclosure is to provide a hygienic pulling waste collector that does not make direct contact with the collected waste.

Another object of the disclosure is to provide a hygienic pulling waste collector that does not require cleaning after use.

Another object of the disclosure is to provide a hygienic pulling waste collector that is odorless after use.

Another object of the disclosure is to provide a hygienic pulling waste collector with a set of locking members for keeping a waste container in position.

Another object of the disclosure is to provide a hygienic pulling waste collector with a set of locking members allowing convenient removal of a waste container disposed inside the waste collector.

Another object of the disclosure is to provide a hygienic pulling waste collector with a pair of locking members mounted to a pair of puller arms for keeping a pair waste container handles in position.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

Generally speaking, pursuant to the various embodiments, the present disclosure provides a hygienic pulling waste collector. The hygienic pulling waste collector includes a frame having a frame leg and a pair of frame arms extending away from the frame leg, a frame handle operatively coupled to the frame leg at an opposite end from the pair of frame arms, a rod operatively coupled to the pair of frame arms, a pair of claws rotatably coupled to the rod, a puller frame adapted to move along the frame leg, and a pair of puller arms extending away from the puller frame and attached to the pair of claws respectively. The pair of puller arms is adapted to close and open the pair of claws. The hygienic pulling waste collector also includes a spring attached to the puller frame and the rod, and a puller handle operatively coupled to the puller frame at an end opposite to the pair of puller arms. When the puller handle is pulled against the frame handle, the pair of puller arms is pulled to cause the pair of claws to open, and the spring is extended to cause the pair of claws. When the puller handle is released from a pulled position, the spring pulls back the puller frame to cause the pair of claws to close.

The hygienic pulling waste collector further includes a pair of locking members mounted to the pair of puller arms respectively. Alternatively, the hygienic pulling waste collector includes a first locking member mounted to the frame leg. The pair of locking members and the first locking member are made of flexible material, each incorporate a first through cut, each is adapted to lock a handle of a waste container, and each is adapted to release the handle of the waste container when the handle of the waste container is pulled away. In addition, the hygienic pulling waste collector includes a second locking member mounted to the rod. The second locking member is made of flexible material, incorporates a second through cut, is adapted to lock a body portion of the waste container, and is adapted to release the body portion of the waste container when the body portion of the waste container is pulled away. In a further implementation, the second locking member is unevenly mounted to the rod.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION

Figure 1:
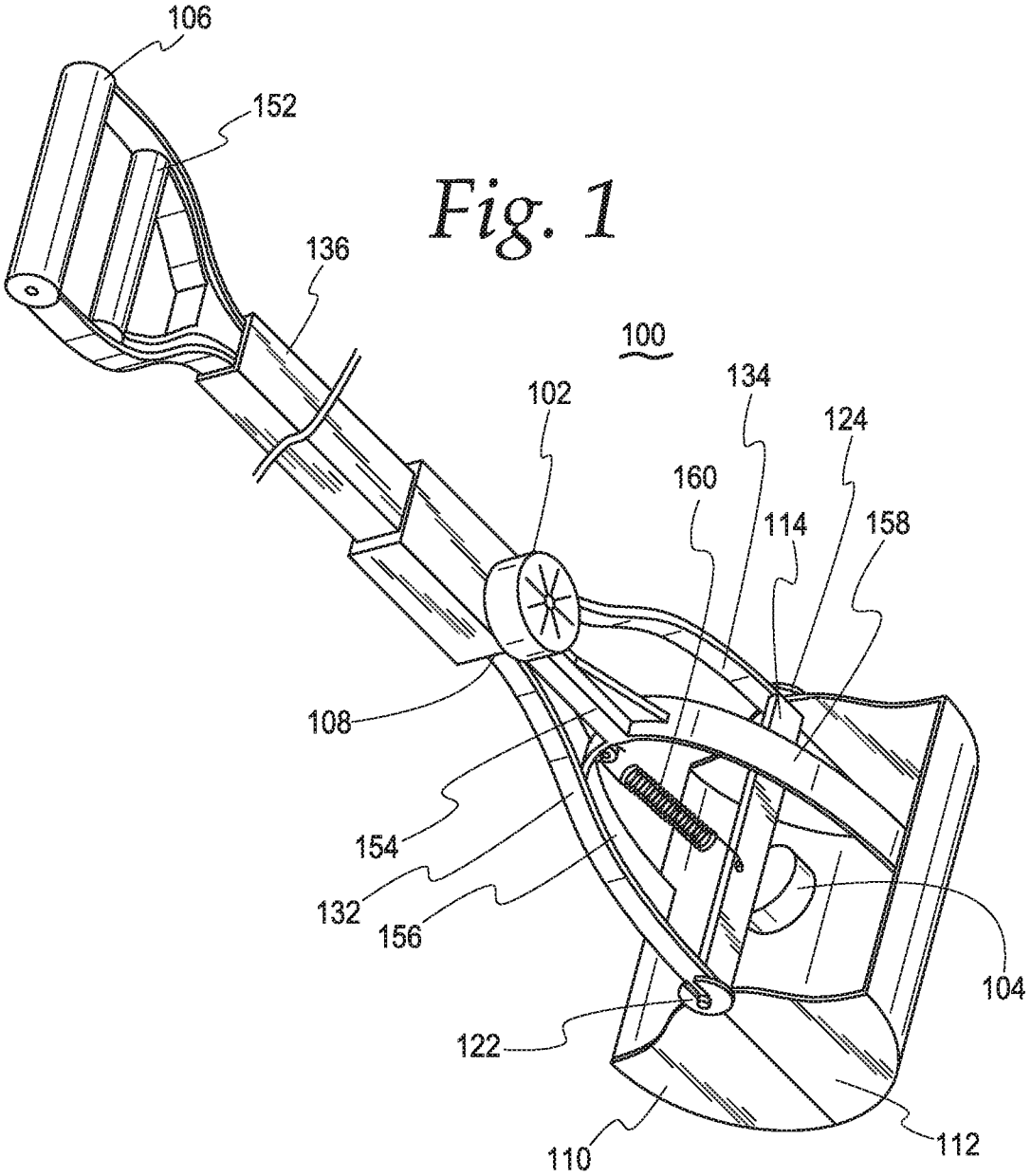
FIG. 1 is a front perspective view of a hygienic pulling waste collector in a closed position in accordance with the present disclosure.

Turning to the figures, and to FIG. 1 in particular, a front perspective view of a hygienic object collecting device in a closed position is shown and generally indicated at 100. The object collecting device 100 incorporates a frame handle 106, a frame 108 having two frame arms 132 and 134 and a frame leg 136, a rod 114, two claws 110 and 112 rotatably mounted to the frame rod 114, a puller handle 152, a puller frame 154, two puller arms 156 and 158 attached to the two claws 110-112 respectively, a spring 160 attached to the puller frame 154 and the rod 114 at two respective ends, a first locking member 102 mounted to the frame leg 136, and a second locking member 104 mounted to the frame rod 114. The puller handle 152, the puller frame 154, the two puller arms 156-158 and the spring 160 are collectively referred to herein as a puller assembly. The frame handle 106, the frame arms 132-134, the frame leg 136, the rod 114, the claws 110-112, the puller handle 152, the puller frame 154, the two puller arms 156-158 can be made of, for example, metal or thermoplastic polymer (such as acrylonitrile butadiene styrene).

The frame handle 106, the frame leg 136 and the frame arms 132-134 are integrally formed or separate parts attached to each other using, for example, screws. As used herein, they are said to be operatively coupled together. The frame handle 106 and the frame arms 132-134 are coupled to the frame leg 136 at two opposite ends. The frame arms 132-134 and the frame rod 122-124 are integrally formed or separate parts attached to each other. As used herein, they are said to be operatively coupled together. The claws 110-112 each incorporate a pair of opposite apertures for receiving the rod 114. When the claws 110-112 are attached to the rod 114, two stoppers 122 and 124 are attached to the rod 114 to keep the claws 110-112 operatively coupled to the rod 114.

In one implementation, the frame leg 136 incorporates a center channel for receiving the puller frame 154, which moves inside the center channel when the puller handle 152 is pulled or released. The puller frame 154 is operatively coupled to the puller handle 152. The puller arms 156-158 extend away from the puller frame 154. The elements 154-158 can be integrally formed or separate parts attached to each other. The puller arms 156-158 are operatively coupled to the two claws 110-112.

Figure 6:
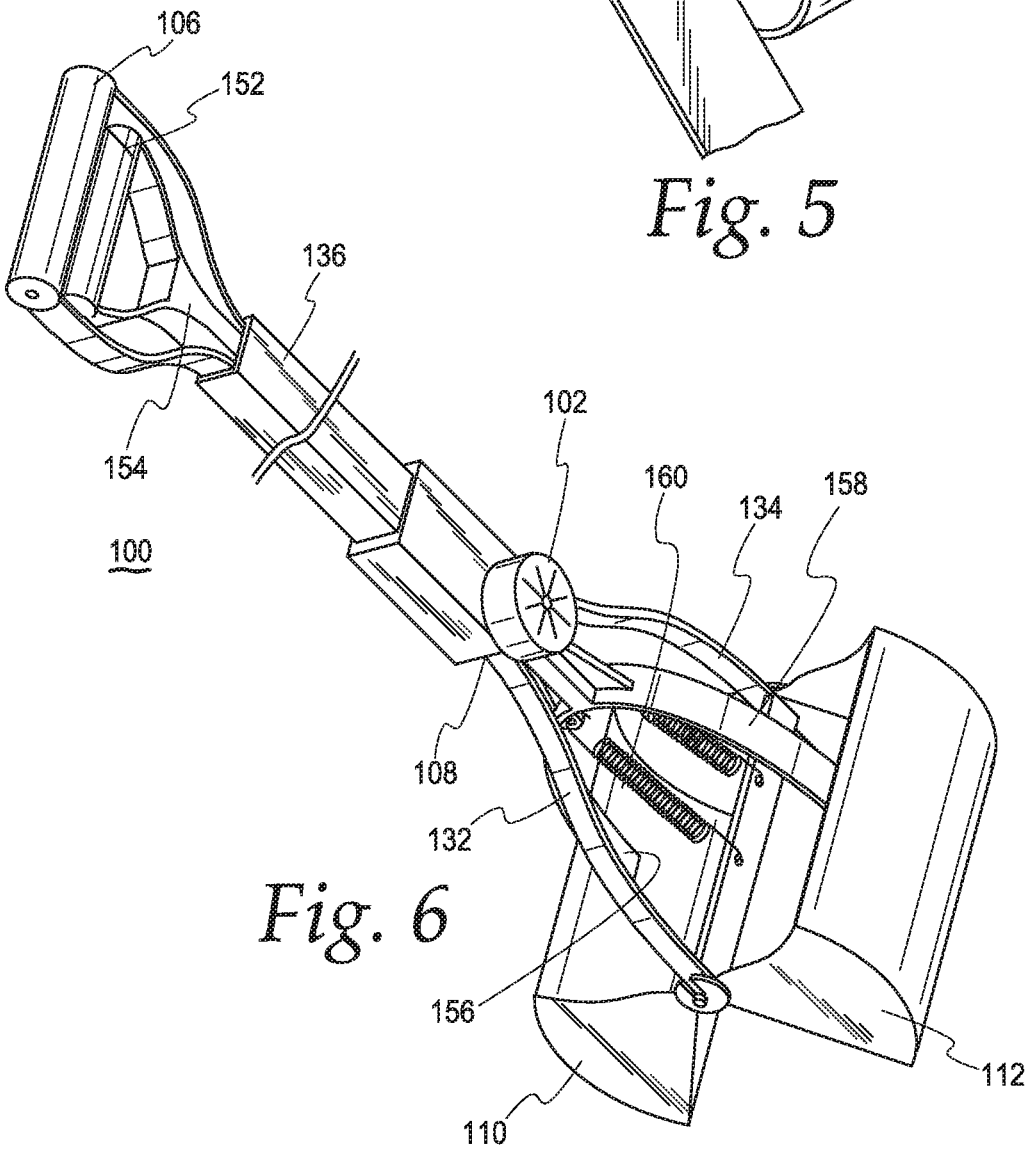
FIG. 6 is a front perspective view of a hygienic pulling waste collector in an open position in accordance with the present disclosure.

When the puller handle 152 is pulled toward the frame handle 106, the spring 160 and the two puller arms 156-158 are pulled toward the frame handle 106. In such a case, the two claws 110-112 are pulled by the puller arms 156-158 respectively, and thus rotate around the frame rod 114 into an open position. The device 100 in the open position is shown in FIG. 6. When the puller handle 152 is released by the user, then the spring 160 pulls the puller frame 154 and the puller arms 156-158. Consequently, the claws 110-112 are pushed into the closed position by the puller arms 156-158.

Figure 2:
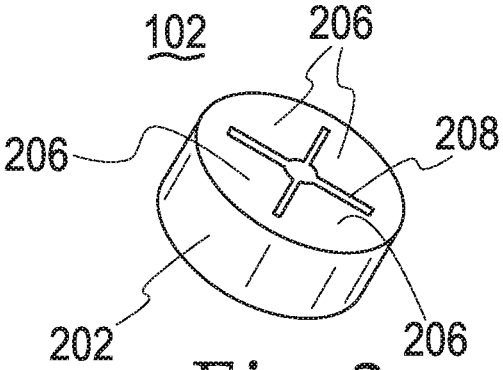
FIG. 2 is a front perspective view of a locking member of a hygienic pulling waste collector in accordance with the present disclosure.

The first locking member 102 is mounted to the frame leg 136, and further illustrated by reference to FIG. 2. The first locking member 102 includes a locking member body 202 with an internal cavity for receiving the handle of a waste container. The first locking member 102 is also referred to herein as a container handle locking member. The first locking member 102 also includes a flexible locking member cover 206. The flexible locking member cover 206 is made of flexible materials (such as rubber), and includes a cut 208 going through the entire thickness of the cover. The cut 208 is also termed herein as a through cut. In one implementation, the cut 208 is a cross cut. The cross cut 208 thus creates four leaves 206. When applied with force, the leaves 206 can be push away from the flat surface of the locking member 102. In addition, when the force against the leaves 206 is removed, the leaves 206 intend to regain their original form.

For example, when a user's finger pushes the handle of a container's handle against the leaves 206, the finger and the container's handle go inside the cavity within the body 202. When the user withdraws the finger from the body 202, the leaves 206 attempt to retain their original form and thus lock the container's handle inside the cavity of the body 202 and between the leaves 206. A partial side view of the flexible locking member cover 206 with the container's handle is shown in FIG. 3.

Figure 3:
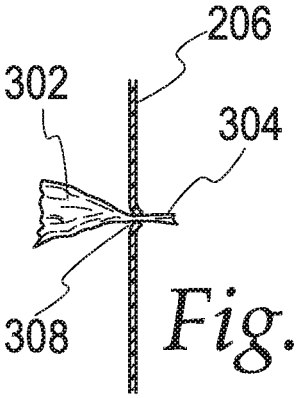
FIG. 3 is a side view of a waste container attached to a locking member of a hygienic pulling waste collector in accordance with the present disclosure.
Figure 7:
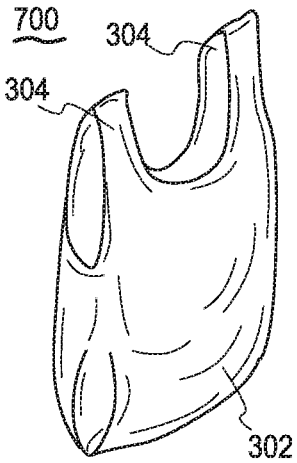
FIG. 7 is a front perspective view of a waste container in accordance with the present disclosure.

Turning to FIG. 3, the container's handle is indicated at 304 while the rest of the container is indicated at 302. The waste container is further illustrated in FIG. 7 and generally indicated at 700. The container 700 is adapted to contain an object, such as a pet's feces.

Alternatively, the flexible locking member cover 206 can be mounted to the frame leg 136, the frame arms 132-134 or the puller arms 156-156 as long as the cover 206 rests above an aperture for receiving the container's handle 304. In such a case, the locking member cover 206 is referred to herein as a locking member.

Figure 4:
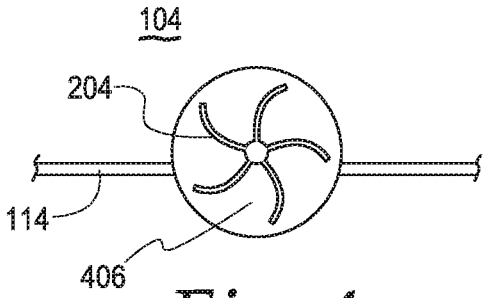
FIG. 4 is a top view of a rod and a locking member mounted to the rod of a hygienic pulling waste collector in accordance with the present disclosure.
Figure 5:
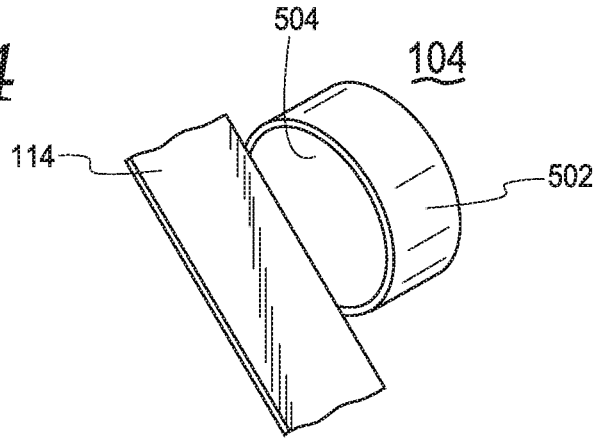
FIG. 5 is a rear perspective view of a rod and a locking member mounted to the rod of a hygienic pulling waste collector in accordance with the present disclosure.

The second locking member 104 is mounted to the rod 114, and further illustrated by reference to FIGS. 4 and 5. Turning first to FIG. 4, a top view of the second locking member 104 and the rod 114 are shown. The second locking member 104 includes a flexible locking member cover 406 including a through cut 404 for locking the container 700 in place. A rear perspective view of the second locking member 104 mounted to the rod 114 is shown in FIG. 5. In the illustrative embodiment, the second locking member 104 includes a body 502 having a cavity 504. The cavity 504 is adapted to receive a part of the container 700 when the container is attached to the device 100.

Figure 10:
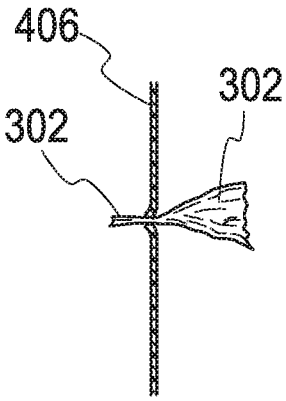
FIG. 10 is a side view of a locking member with a waste container attached to in accordance with the present disclosure.

The middle line of the rod 114 along its length does not run through the center of the body 502. Therefore, the body 502 is more exposed on one side of the rod 114 than the other. The uneven mounting of the body 502 to the rod 114 allows a user's finger to reach beyond the rod 114 when the finger penetrates through the cover 406. The direct benefit is that more of the container can be inserted through the cover 406 and disposed inside the body 502. A partial side view of the cover 406 with the container body 302 locked in position is shown in FIG. 10.

Alternatively, the flexible locking member cover 406 can be mounted to the rod 114 as long as the cover 406 covers an aperture in the rod 114 for receiving a small portion of the container's body 302. In such a case, the locking member cover 406 is also referred to herein as a locking member.

Figure 8:
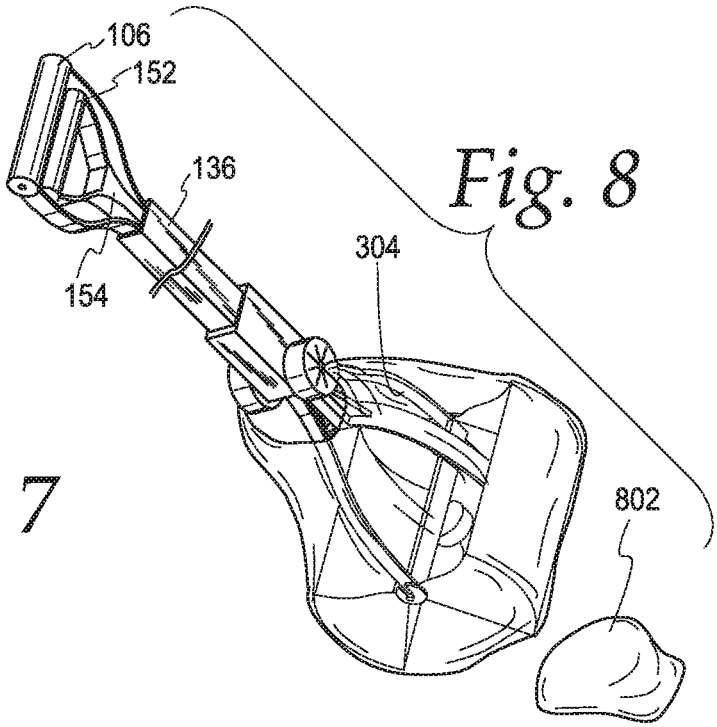
FIG. 8 is a front perspective view of a hygienic pulling waste collector in an open position with a waste container attached to in accordance with the present disclosure.

To use the hygienic pulling waste collector 100, a user opens the claws 110-112, places a hand into the container 700, uses a finger to push the middle of the bottom part of the container 700 through the through cut 404, withdraws the finger and leaves the portion of the container 700 that is pushed through the through cut 404 behind, flips the container 700 inside out, wraps the container 700 around the claws 110-112, uses a finger to push the handles 304 through the through cut 308, and withdraws the finger and leaves the portion of the handle 304 that is pushed through the through cut 308 behind. The hygienic pulling waste collector 100 with the container 700 attached for use is shown in FIG. 8.

When the user intends to collect an object, such as a piece of waste 802, the user pulls the puller handle 152 toward the end of the frame handle 106 to open the claws 110-112, places the claws 110-112 to cover the waste 802, releases the puller handle 152 to cause the claws 110-112 to close and thus scoop the waste 802 into the container 700, pulls the handles 304 out of the first locking member 102, pulls the container 700 out of the second locking member 404 and the claws 110-112, and then properly handles the container 700 with the waste 802 (such as through it into a garbage can). The frame leg 136 is sufficient long such that an adult can operate the collector 100 to pick up the waste 802 while standing.

Figure 9:
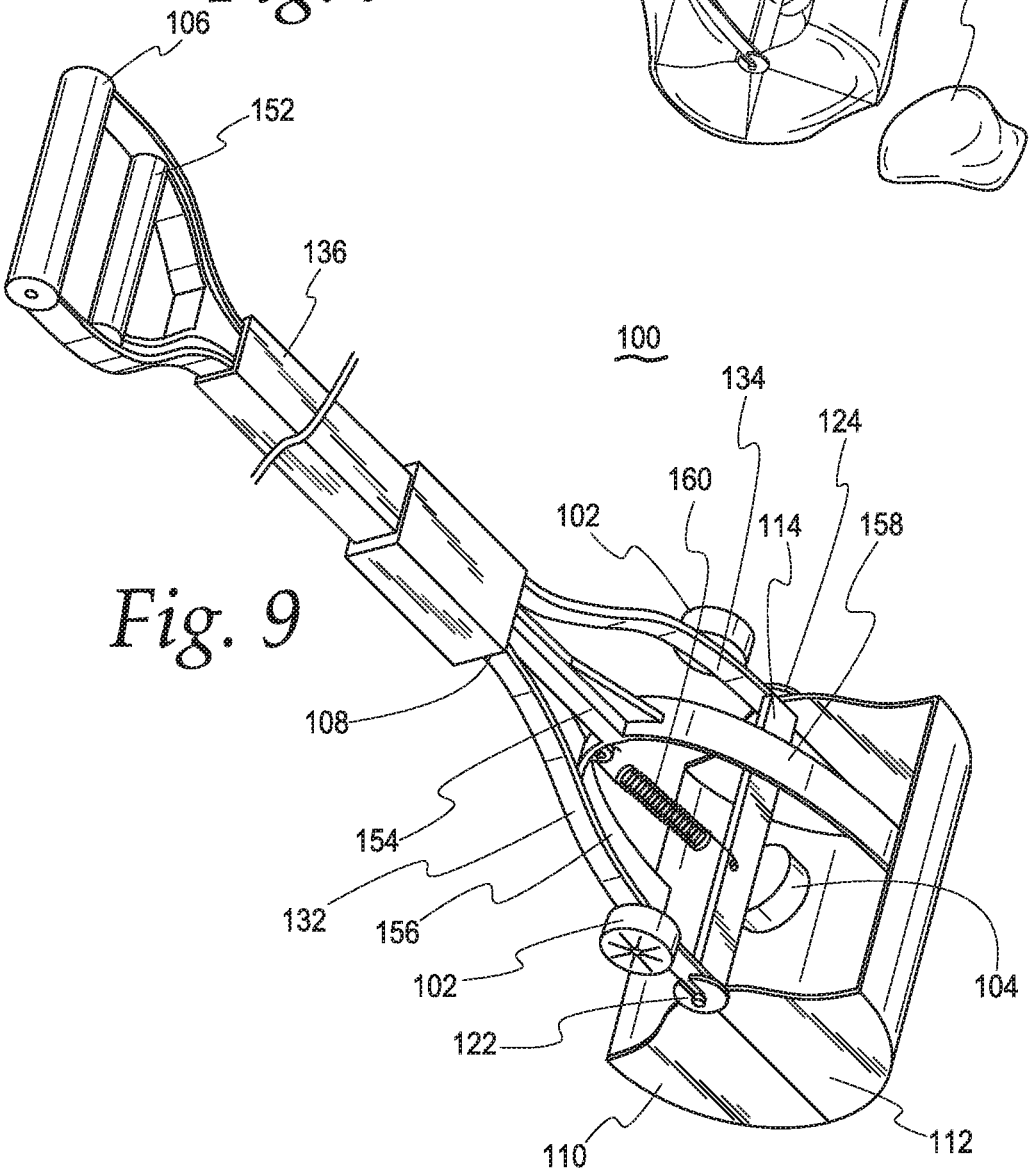
FIG. 9 is a front perspective view of a hygienic pulling waste collector in a closed position in accordance with the present disclosure.

In a different implementation, as shown in FIG. 9, the first locking member 102 is mounted to one or two of the frame arms 132-134. Whether the first locking member 102 is mounted to the frame leg 136 or one or two of the frame arms 132-134, it is said to be mounted to the frame 108 of the hygienic pulling waste collector 100.

Figure 11:
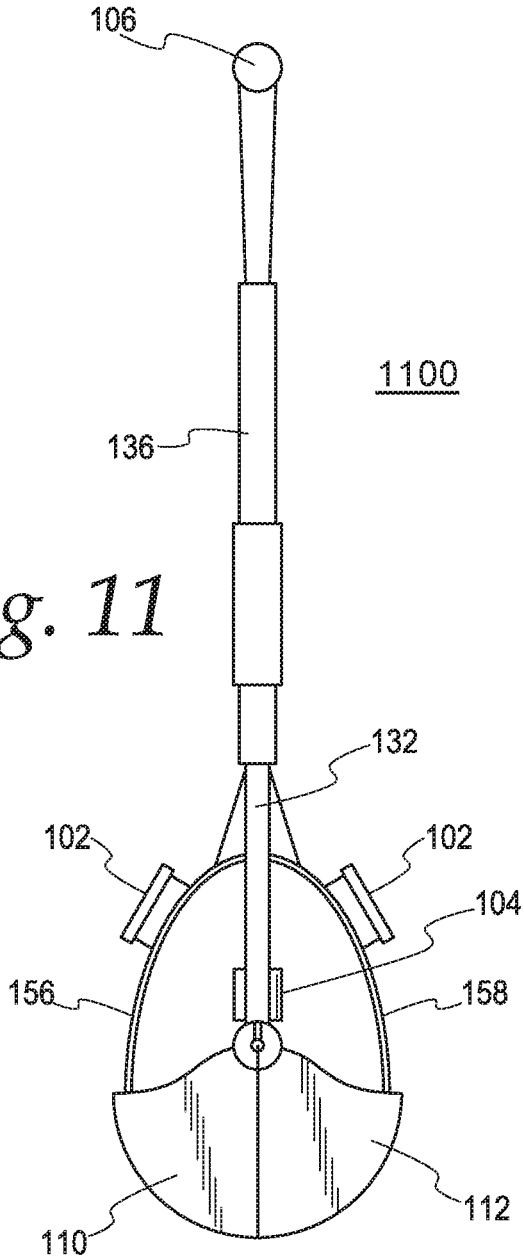
FIG. 11 is a side view of a hygienic pulling waste collector in a closed position in accordance with the present disclosure.

In another implementation, as shown in FIG. 11, the first locking member 102 is mounted to the puller arm 158. In such a case, the first locking member 102 is also said to be mounted to a puller assembly of the hygienic pulling waste collector 100. The puller assembly includes the puller handle 152, the puller frame 154, the puller arms 156-158, and the spring 160.

Referring now to FIG. 11, a side view of a hygienic pulling waste collector with two locking members mounted to the two puller arms is shown and generally indicated at 1100. Different from the collector 100, the collector 1100 includes two locking members 102, and they are operatively coupled to the two puller arms 156-158 respectively, instead of the frame leg 136.

Obviously, many additional modifications and variations of the present disclosure are possible in light of the above teachings. Thus, it is to be understood that, within the scope of the appended claims, the disclosure may be practiced otherwise than is specifically described above.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A hygienic pulling waste collector comprising:

a) a frame having a frame leg and a pair of frame arms extending away from said frame leg;

b) a frame handle operatively coupled to said frame leg at an opposite end from said pair of frame arms;

c) a rod operatively coupled to said pair of frame arms;

d) a pair of claws rotatably coupled to said rod;

e) a puller frame adapted to move along said frame leg;

f) a pair of puller arms extending away from said puller frame and attached to said pair of claws respectively, said pair of puller arms adapted to close and open said pair of claws;

g) a spring attached to said puller frame and said rod;

h) a puller handle operatively coupled to said puller frame at an end opposite to said pair of puller arms, wherein, when said puller handle is pulled against said frame handle, said pair of puller arms is pulled to cause said pair of claws to open and said spring is extended, and wherein, when said puller handle is released from a pulled position, said spring pulls back said puller frame to cause said pair of claws to close;

i) a pair of locking members mounted to said pair of puller arms respectively, each locking member within said pair of locking members made of flexible material, incorporating a through cut, adapted to lock a handle of a waste container, and adapted to release said handle of said waste container when said handle of said waste container is pulled away; and j) a third locking member mounted to said rod, said third locking member made of flexible material, incorporating a third through cut, adapted to lock a body portion of said waste container, said third locking member adapted to release said body portion of said waste container when said body portion of said waste container is pulled away.

2. The hygienic pulling waste collector of claim 1 wherein said third locking member is unevenly mounted to said rod.

3. A hygienic pulling waste collector comprising:

a) a frame having a frame leg and a pair of frame arms extending away from said frame leg;

b) a frame handle operatively coupled to said frame leg at an opposite end from said pair of frame arms;

c) a rod operatively coupled to said pair of frame arms;

d) a pair of claws rotatably coupled to said rod;

e) a puller frame adapted to move along said frame leg;

f) a pair of puller arms extending away from said puller frame and attached to said pair of claws respectively, said pair of puller arms adapted to close and open said pair of claws;

g) a spring attached to said puller frame and said rod;

h) a puller handle operatively coupled to said puller frame at an end opposite to said pair of puller arms, wherein, when said puller handle is pulled against said frame handle, said pair of puller arms is pulled to cause said pair of claws to open and said spring is extended, and wherein, when said puller handle is released from a pulled position, said spring pulls back said puller frame to cause said pair of claws to close;

i) a first locking member mounted to said frame leg, said first locking member made of flexible material, incorporating a first through cut, adapted to lock a handle of a waste container, and adapted to release said handle of said waste container when said handle of said waste container is pulled away; and j) a second locking member mounted to said rod, said second locking member made of flexible material, incorporating a second through cut, adapted to lock a body portion of said waste container, said second locking member adapted to release said body portion of said waste container when said body portion of said waste container is pulled away.

4. The hygienic pulling waste collector of claim 3 wherein said second locking member is unevenly mounted to said rod.

5. A hygienic pulling waste collector comprising:

a) a frame having a frame leg and a pair of frame arms extending away from said frame leg;

b) a frame handle operatively coupled to said frame leg at an opposite end from said pair of frame arms;

c) a rod operatively coupled to said pair of frame arms;

d) a pair of claws rotatably coupled to said rod;

e) a puller frame adapted to move along said frame leg;

f) a pair of puller arms extending away from said puller frame and attached to said pair of claws respectively, said pair of puller arms adapted to close and open said pair of claws;

g) a spring attached to said puller frame and said rod;

h) a puller handle operatively coupled to said puller frame at an end opposite to said pair of puller arms, wherein, when said puller handle is pulled against said frame handle, said pair of puller arms is pulled to cause said pair of claws to open and said spring is extended, and wherein, when said puller handle is released from a pulled position, said spring pulls back said puller frame to cause said pair of claws to close; and i) a first locking member mounted to said frame, said first locking member adapted to lock a handle of a waste container, said first locking member adapted to release said handle of said waste container when said handle of said waste container is pulled away, said first locking member incorporating a cover made of a flexible material and having a through cut.

6. The hygienic pulling waste collector of claim 5 wherein said first locking member is mounted to said frame leg.

7. The hygienic pulling waste collector of claim 5 wherein said first locking member is mounted to a frame arm within said pair of frame arms.

8. The hygienic pulling waste collector of claim 7 further comprising a second locking member, wherein said first locking member and said second locking member are mounted to different frame arms of said pair of frame arms.

9. The hygienic pulling waste collector of claim 5 further comprising a second locking member mounted to said rod, said second locking member adapted to lock a body portion of said waste container, said second locking member adapted to release said body portion of said waste container when said body portion of said waste container is pulled away.

10. The hygienic pulling waste collector of claim 9 wherein said second locking member is unevenly mounted to said rod.

11. The hygienic pulling waste collector of claim 9 wherein said second locking member incorporates a cover made of a flexible material and having a through cut.

12. The hygienic pulling waste collector of claim 5 further comprising a second locking member mounted to said frame and a third locking member mounted to said rod, said second locking member and said third locking member each adapted to lock a body portion of said waste container, said second locking member and said third locking member each adapted to release said body portions of said waste container when said body portions of said waste container are pulled away.

13. The hygienic pulling waste collector of claim 12 wherein said first and second locking members are mounted to different frame arms of said pair of frame arms and said third locking member is unevenly mounted to said rod.

14. The hygienic pulling waste collector of claim 12 wherein said second and third locking members each incorporate a cover made of a flexible material and having a through cut.

* * * * *